United States Patent [19]

Pronovost et al.

[11] 4,209,980

[45] Jul. 1, 1980

[54] WOBBLE PLATE ENGINE

[75] Inventors: Jacques O. Pronovost; Harry A. Derderian, both of Guelph, Canada

[73] Assignee: ECO Motor Industries Ltd., Guelph, Canada

[21] Appl. No.: 38,132

[22] Filed: May 11, 1979

[51] Int. Cl.[2] ..... F02G 1/04

[52] U.S. Cl. ..... 60/517; 60/520

[58] Field of Search ..... 60/517, 518, 519, 520, 60/526, 39.6; 62/6

[56] References Cited

U.S. PATENT DOCUMENTS

| | | | |
|---|---|---|---|
| 2,508,315 | 5/1950 | Van Weenen et al. | 60/518 |
| 3,183,662 | 5/1965 | Kor | 60/518 |

*Primary Examiner*—Edgar W. Geoghegan

*Attorney, Agent, or Firm*—Cullen, Sloman, Cantor, Grauer, Scott & Rutherford

[57] ABSTRACT

The reciprocating motion of the power piston of a Stirling cycle engine is converted to rotation of an output shaft by means of a gimbal-mounted wobble plate. The output shaft has a cylindrical bearing surface whose axis is at an acute angle to that of the shaft and which surface rotates within the nonrotating wobble plate. The wobble plate oscillates about its mounting axis within the gimbal, and the gimbal in turn oscillates about a third axis which is mutually perpendicular to and intersecting with the wobble plate mounting axis and the rotational axis of the output shaft. The power piston rod is connected to the gimbal to cause it to oscillate, which in turn induces rotation of the output shaft. The reciprocation of the displacer piston is phased to that of the power piston by means of a reciprocating slide which is connected to the displacer piston rod and driven by a ball-like cam and socket interconnection with the wobble plate. The displacer piston has two segments which are axially separated by an insulator to provide maximum temperature differential between its hot and cold ends.

8 Claims, 14 Drawing Figures

WOBBLE PLATE ENGINE

BACKGROUND OF INVENTION

This invention generally relates to Stirling cycle engines. The Stirling cycle, invented over 150 years ago, utilizes external combustion and takes advantage of the principle of regeneration to recapture heat which would otherwise be lost from the cycle. In the form of the Stirling cycle disclosed herein, heat from the external source of combustion is utilized to heat a chamber at one end of an open-ended cylinder. Within the cylinder, a displacer piston and a power piston co-axially reciprocate, with the displacer piston being at the closed or heated end of the cylinder and the power piston being at the open end of the cylinder.

One feature of the present invention involves the mechanism by which the reciprocation of the power piston is converted to rotation of an output shaft oriented parallel to the axis of piston reciprocation.

Another feature of the present invention relates to a novel means by which the reciprocation cycles of the two pistons are inter-related according to a predetermined phase angle.

The present invention is intended to be used in applications where long maintenance-free operation is essential, with dry lubrication. It is therefore essential to minimize the side loading between the power piston and the cylinder walls. Another feature of the present invention therefore involves the isolation of the power piston from lateral forces induced as reactions to the output torque or drive line forces.

Part of the thermal efficiency of a Stirling cycle engine involves the cooling down and contraction of the gas between the two pistons after the power stroke, to aid in the return stroke of the power piston. The present invention also involves an improved displacer piston construction to thermally insulate the cooling space end of the displacer piston from the heated end of the displacer piston.

These and other objects of the present invention will become more readily apparent from the detailed disclosure which follows.

SUMMARY OF THE INVENTION

The power piston is provided with a bifurcated piston rod which enables the piston rod of the displacer piston to pass axially through the center of the power piston without interference between the two rods.

The power piston rod is connected to a gimbal arrangement which is caused to oscillate about an axis perpendicular to and displaced from the piston reciprocation axis in response to the reciprocation of the power piston.

A wobble plate is pivotally mounted within the gimbal means about an axis mutually perpendicular to and intersecting the oscillation axis of the gimbal and the rotational axis of the output shaft. The output shaft is provided with a cylindrical bearing surface at an acute angle to the shaft axis, and bearing means between such bearing surface and the wobble plate permit the output shaft to rotate within the non-rotating but oscillating wobble plate.

The oscillation of the wobble plate about its pivotal axis within the gimbal is utilized to create reciprocating motion of the displacer piston as a result of a connection between a ball-like cam on the wobble plate and a socket or slot in a slide which is connected to the displacer piston. The location of the cam on the wobble plate establishes the predetermined phase relationship between the reciprocating strokes of the two pistons, here selected so that the displacer piston leads the power piston by approximately a ninety degree phase angle. Lateral reaction forces in the drive train and torque reaction forces are absorbed by the interconnection between the gimbal and the supporting frame, to minimize side loading on the power piston.

The displacer piston is fabricated of two axially spaced segments which are separated by a thermally insulating spacer.

DETAILED DESCRIPTION OF THE DISCLOSURE

Figure 2:
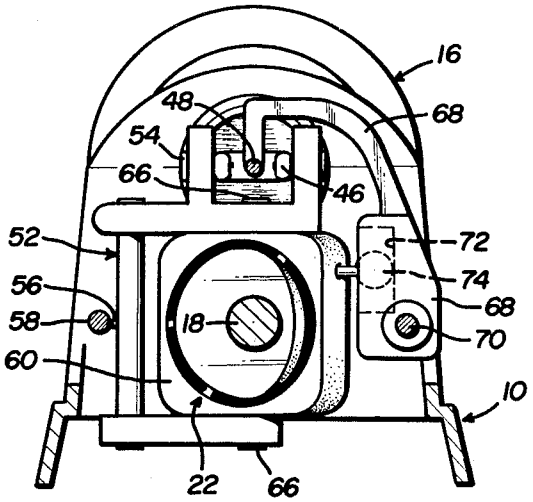
FIG. 2 is a cross-sectional view in the direction of arrows 2-2 of FIG. 1.

The Stirling cycle engine of the present invention generally comprises a supporting frame 10, external combustion chamber 12, cylinder 14 containing the reciprocating pistons, cylinder housing 16 provided with external cooling fins, drive shaft 18 having mounted thereon flywheel 20, and wobble plate assembly 22 for converting the reciprocation of the power piston to rotation of the output shaft.

Figure 1:
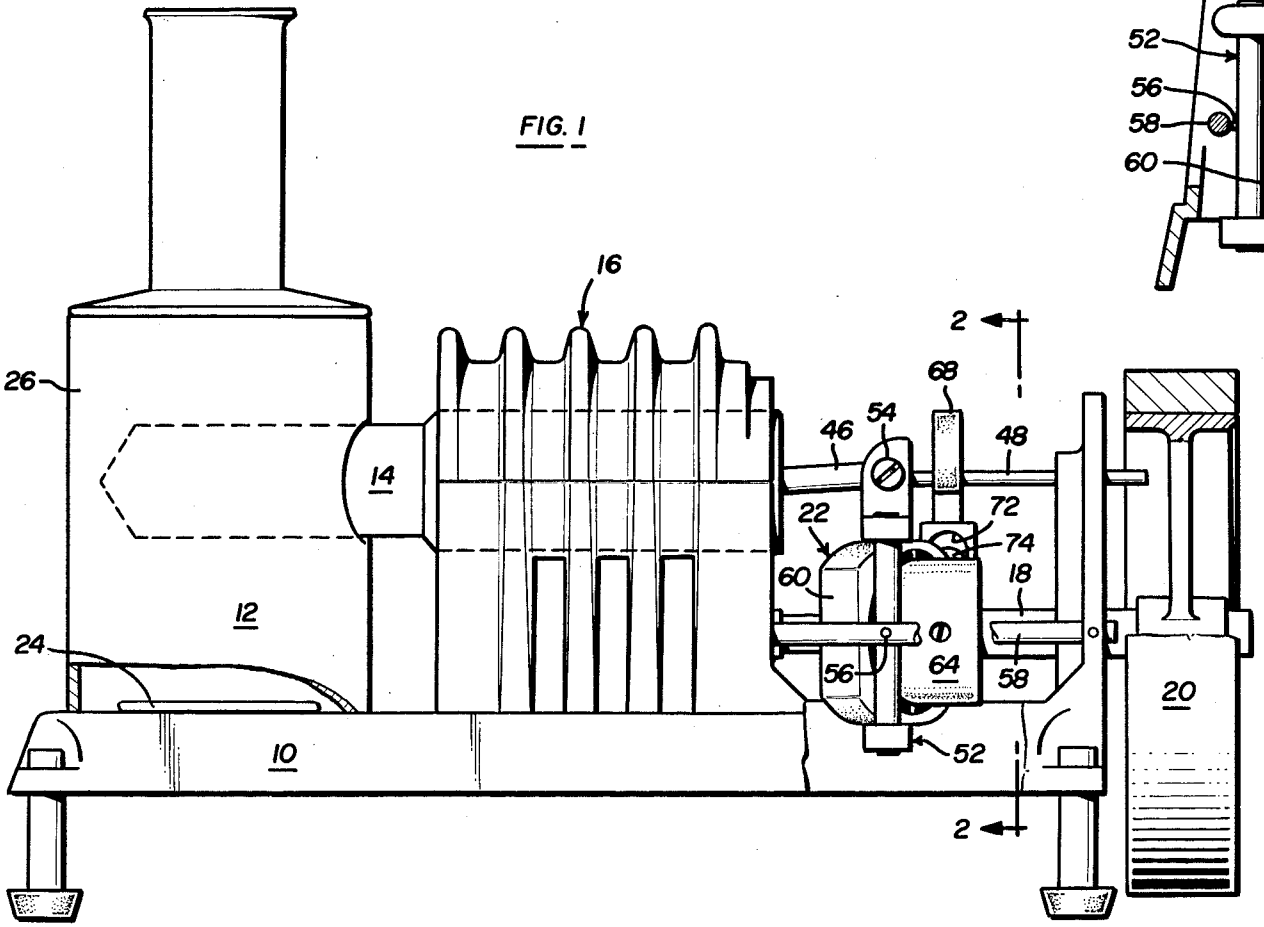
FIG. 1 is a side elevation of the Stirling cycle of the present invention.

Referring now to FIG. 1, in particular, external combustion chamber 12 is removably mounted on supporting frame 10, and, as revealed by the broken away portion, contains a wick type burner 24 which is a useful source of fuel and heat for a small demonstration model version of the present invention. Typically, a fuel such as wood alcohol can be used to soak the wick. Other types of fuels and burner constructions could alternatively be used, as will be recognized by those skilled in the art. The left end of cylinder 14 projects into removable chimney 26 of external combustion chamber 12, to be heated by the combustion from burner 24.

As best shown in FIGS. 3A-3D, cylinder 14 comprises a small bore portion 28 at the left or hot end and a large bore portion 30 at the right or open end. A bronze bearing sleeve 32 lines the interior of the large bore end of the cylinder.

The small bore end of the cylinder contains displacer piston assembly 34, which in turn comprises a hot end segment 36 fabricated of stainless steel and a cool end segment 38 fabricated of aluminium, these segments being separated by a ceramic or asbestos thermal insulating spacer 40. These segments may be assembled by means of a central threaded stud. The cool end segment 38 is provided with a multi-lobed bearing-spacer 42, which may be fabricated of a material such as Teflon, and whose lobes or high points serve to support and center the diametrically undersize displacer piston within the bore of cylinder 14.

Power piston 44 is provided with a bifurcated connecting rod 46 (shown also in FIG. 2) and which is pivotally mounted to power piston 44 in conventional fashion. Power piston rod 46 is bifurcated so as to permit passage of displacer piston rod 48 through the center of power piston 44 and between the two legs of power piston rod 46. Piston rod 48 is telescopically received in and further guided by a tubular guide 50 mounted on the left end of power piston 44.

As best shown in FIGS. 1 and 2, a generally U-shaped gimbal 52 is pivotally connected at 54 to the outer end of power piston connecting rod legs 46. Gimbal 52 is also mounted for oscillation by means of a pivotal connection at 56 to support rod 58 forming part of supporting frame 10. Pivotal connection 56 permits gimbal 52 to oscillate about a horizontal transverse axis (i.e., perpendicular to the plane of the paper in FIG. 1) which is perpendicular to and intersects the rotational axis of output shaft 18.

Wobble plate 60 is rotatably mounted on a cylinder bearing surface 62 (best shown in FIG. 4A) which rotates with output shaft 18. The axis of cylindrical bearing surface 62 intersects the rotational axis of output shaft 18 at an acute angle, here selected to be about 30 degrees. Preferably, ball bearings would be utilized to permit free rotation of the output shaft and bearing surface 62 within the oscillating but non-rotating wobble plate 60. A second cylindrical portion 64, coaxial with the axis of output shaft 18, forms a further portion of the wobble plate supporting structure.

Wobble plate 60 is further supported by means of pivotal connections 66 (see FIG. 2) between the wobble plate and the uper and lower horizontal legs of gimbal 52. The pivot axis through connections 66 is mutually perpendicular to and intersecting both the transverse horizontal axis through gimbal support rod connection 56 and the rotational axis of output shaft 18. Thus, non-rotating wobble plate 60 is capable of oscillation about both the pivotal connection through 56 and the pivotal connection through 66.

Also as best shown in FIGS. 1-2, a slide member 68 is slidably supported on rod 70 which is fixed to mounting frame 10 in a position symmetrical to rod 58. Slide 68 contains a slot or socket 72 which receives wobble plate ball cam 74 projecting from one side of wobble plate 60. The upper portion of slide 68 is connected to displacer piston rod 48 so that reciprocation of slide 68 induces corresponding reciprocation of displacer piston 34.

OPERATION

Figure 3A:
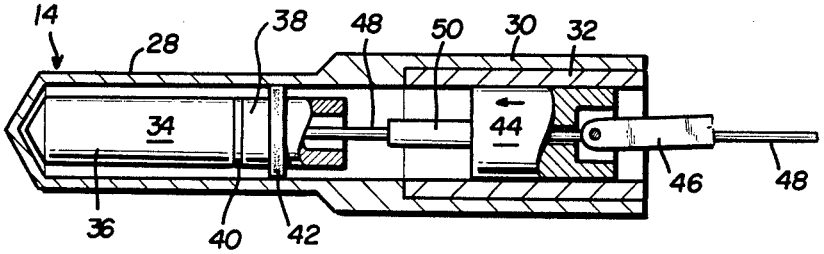
FIG. 3A through FIG. 3D are a series of cross-sectional views showing a sequence of relative positions of the displacer and power pistons within the cylinder, the direction of view being the same as that of the elevation of FIG. 1.

Leaving aside, for the moment, the explanation of operation of the wobble plate assembly, and focusing on the operation of the pistons in accordance with the Stirling cycle, reference should be made to FIGS. 3A-3D. The illustrated sequence begins shortly after the completion of a power stroke, that is, the rightward stroke of power piston 44. As shown in FIG. 3A, power piston 44 is moving toward the left, and displacer piston 34 is in its fully retracted position toward the left or hot end of cylinder 14. The cooling of the hot gas within the space between the two pistons creates a partial vacuum, which, along with the momentum of flywheel 20, draws power piston 44 toward the left.

Figure 3B:
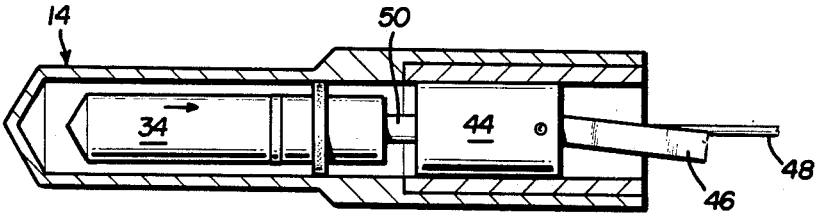

In the position of FIG. 3B, output shaft 18 has rotated another ninety degrees (in the counter-clockwise direction as viewed in FIG. 2), bringing power piston 44 to its innermost position, and displacer piston 34 has started moving toward the right. As displacer piston 34 moves into the cooling space between the two pistons (i.e., toward power piston 44), it displaces the cooled gas from such cooling space toward the left through the annular gap between displacer piston 34 and the inner walls of cylinder 14. Thus, the cooled gas is displaced to the hot or left end of cylinder 14, to commence another heating cycle.

It should here be noted that this flow of cool gas over piston 34 is made possible by the annular gap, for bearing-spacer 42 preferably has only three or four lobes or high points to establish frictional contact with the inner wall of the cylinder, otherwise leaving the annular gap open for passage of gas. Conversely, essentially no gas leaks past power piston 44, which snugly fits within bearing sleeve 32 and which may be provided with labyrinth type seals in the form of axially spaced peripheral grooves which create turbulence and successive pressure drops to effectively seal the interior of the cylinder.

Figure 3C:
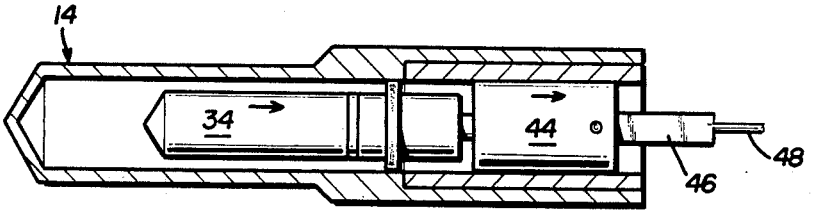

Continuing with the sequence, the condition of FIG. 3C shows displacer piston 34 fully extended toward the right, with power piston 44 having begun its rightward power stroke in response to the heating and expansion of the gas at the left end of the cylinder and its by-passing of displacer piston 34 and impingement against the left face of power piston 44. The position of the pistons in FIG. 3C represents just under 90 degrees of additional output shaft rotation from the position of FIG. 3B.

Figure 3D:
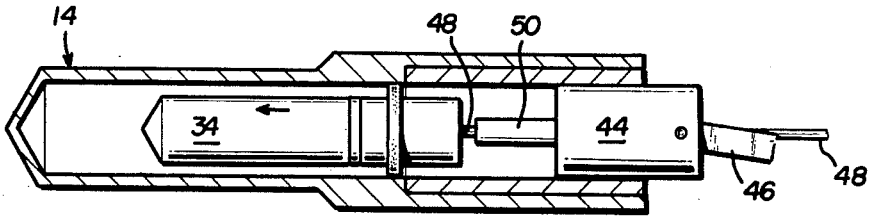

FIG. 3D shows the position of the pistons after an additional hundred degrees of rotation of the output shaft from its position in FIG. 3C, and shows the power piston fully extended at the conclusion of its power stroke and displacer piston 34 beginning to move toward the left so as to displace or transfer the hot gas which remains at the left end of the cylinder into the cooling space between the two pistons.

Another 90 degrees of output shaft rotation from the position of FIG. 3D will bring the pistons back to the position of FIG. 3A, where the displacer piston has completed its hot gas displacing stroke toward the left and the cooling and contraction of the gas between the two pistons has begun to pull power piston 44 back into the cylinder.

Referring now to the operation of the drive line mechanism or wobble plate assembly, best shown in FIGS. 4A-4F, these figures arbitrarily show the position of the mechanism at intervals of 45 degrees of counter-clockwise rotation of output shaft 18, as viewed in the direction of arrows 2—2.

Figure 4A:
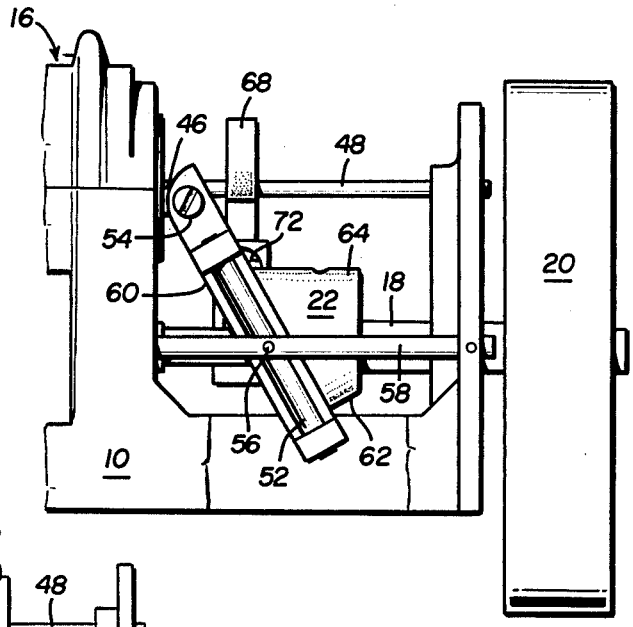
FIG. 4A through FIG. 4H are a series of fragmentary elevational views showing the drive line in a sequence of positions at intervals of 45 degrees of rotation of the output shaft.
Figure 4B:
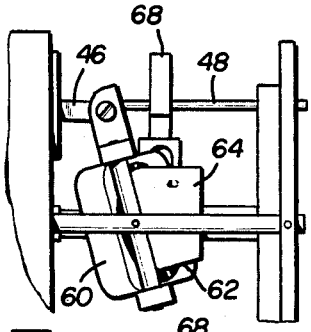
Figure 4C:
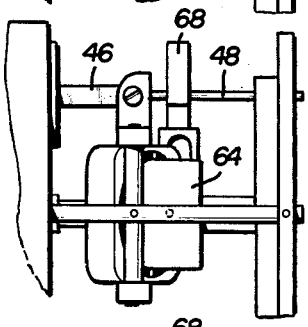
Figure 4D:
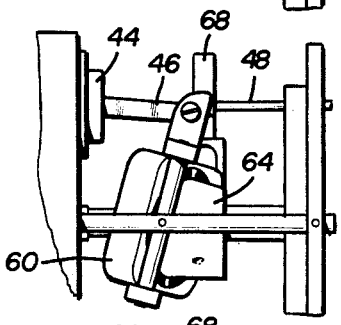
Figure 4E:
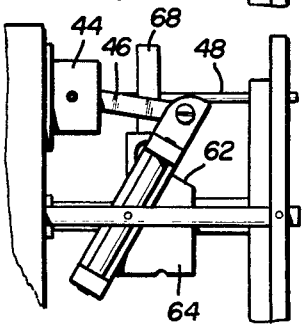
Figure 4H:
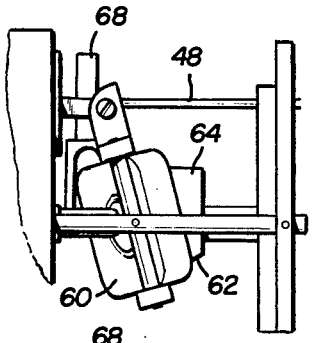
Figure 4G:
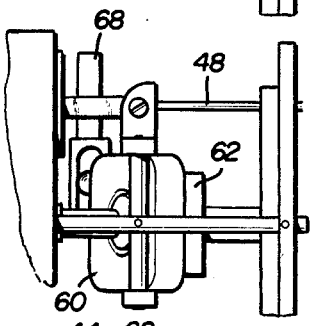
Figure 4F:
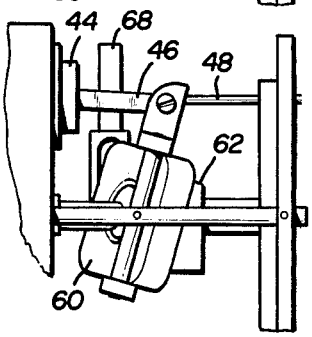

The portion of the cycle illustrated in FIG. 4A represents the innermost position of the power piston as revealed by the extreme leftward tilt of the upper portion of gimbal 52. Following through the sequence of FIGS. 4A-4F, it will be seen that the upper end of gimbal 52, and therefore also power piston connecting rod 46 and power piston 44, moves toward the right to the position of FIG. 4E and then returns toward the left in the sequence of FIGS. 4F through 4H and back to FIG. 4A.

Similarly, referring to FIG. 4A, slide 68, and therefore also displacer piston connecting rod 48 and displacer piston 34, are shown at a position approximately midway in the stroke. Slide 68 reaches its rightward-most position between FIGS. 4C and 4D, and then moves toward the left and reaches its extreme leftward position at about the position shown in FIG. 4H.

In terms of cause and effect, the rightward power stroke of power piston 44, through its connection 54 to gimbal 52, forces gimbal 52 to pivot clockwise about pivot axis 56. Because wobble plate 60 is restrained from rotation by its connections 66 to gimbal 52, such movement of gimbal 52 causes wobble plate 60 to force output shaft 18 to rotate counter-clockwise.

The simultaneous oscillation of wobble plate 60 about the two mutually perpendicular axes, that is, the axis through connection 56 and the axis through connection 66, causes the wobble plate ball-like cam 74 to follow a predetermined path in the left-right direction, which motion is communicated to slide 68 through slide socket or slot 72. This motion of slide 68 causes corresponding reciprocation of displacer piston assembly 34.

In the embodiment of the invention illustrated and described herein, the placement of wobble plate ball cam 74 relative to the point of connection to power piston rod 46 at 54 was selected to provide a phase relationship between the strokes of the two pistons such that displacer piston 34 leads power piston 44 by about 90 degrees of rotation of output shaft 18. That is a preferred phase relationship, but, as those skilled in the art will recognize, other phase relationships could be readily provided by changing the point at which such cam is mounted on the wobble plate.

The Stirling cycle engine disclosed herein is intended to be especially adapted for applications requiring fractional or very low horsepower where radiation of generated heat can be accomplished from the cooling fins formed on housing 16. The alternative to air cooling would be water cooling or intake and exhaust valves, both of which are far more costly.

The unit has also been conceived to require an absolute minimum of maintenance and lubrication, with lubrication being in the form of very fine dry powdered coating on power piston 44. Such coatings, which are known in the art, may consist of a Teflon-based material in a polyamide binder.

Because such lubricants do not have high load-carrying capacity, it is important to minimize side loading of the power piston against the cylinder walls. The reaction caused by the output torque as well as by the forces within the drive mechanism are taken out at gimbal support rod connection 56, which is capable of taking loads along all three mutually perpendicular axes.

The overall configuration of the engine permits a second cylinder to be added parallel to the first cylinder, but diametrically opposite the axis of output shaft 18, so that the second power piston may be connected to the lower end of gimbal 52.

This invention may be further developed within the scope of the following claims. Accordingly, the above specification is to be interpreted as illustrative of only a single operative embodiment of this invention, rather than in a strictly limited sense.

I now claim:

1. In a conventional Stirling cycle engine of the type characterized by an elongated cylinder having a closed end and an open end, means for applying heat to the exterior of the cylinder to heat gas in the interior of the cylinder at the closed end thereof, a displacer piston mounted for a reciprocation within the closed end of the cylinder and a power piston axially aligned with the displacer piston and mounted for coaxial reciprocation between the displacer piston and the open end of the cylinder, the reciprocation of the displacer piston leading the corresponding stroke of the power piston by a predetermined phase angle, the improved means for properly phasing the reciprocation of the two pistons and for converting the reciprocation of the power piston into rotation of an output shaft which is parallel to the axis of reciprocation comprising:

a supporting frame;

an output shaft mounted on said frame for rotation about a first axis which is parallel to the axis of reciprocation of the two pistons, said shaft having an inclined cylindrical bearing surface the axis of which intersects said first axis at an acute angle;

gimbal means pivotally mounted on said supporting frame for oscillation about a second axis perpendicular to and intersecting first axis;

a wobble plate pivotally mounted on a third axis within said gimbal means for oscillation with said gimbal means and for further oscillation about said third axis which is mutually perpendicular to and intersecting said first and second axes, said wobble plate being rotatably mounted on said inclined cylindrical bearing surface in a plane which is perpendicular to said axis of said bearing surface whereby said output shaft can rotate about said first axis as said wobble plate oscillates about said second and third axes;

a power piston rod connected at one end to said power piston for reciprocation therewith and extending out of the open end of the cylinder for connection at its other end to said gimbal means, whereby reciprocation of said power piston causes said gimbal means to oscillate about said second axis;

a displacer piston rod connected at a first end to said displacer piston for reciprocation therewith and extending out of the open end of the cylinder for connection to a slider member which is mounted for reciprocating movement along an axis supported by said frame and parallel to said first axis;

connecting means between said slider member and said wobble plate for causing said slider member and said displacer piston rod and displacer piston to reciprocate in response to the oscillation of said wobble plate;

reciprocation of said power piston causing said gimbal means and said wobble plate to oscillate about said second axis, which motion causes said output shaft to rotate due to the mounting of the wobble plate thereon, the resulting oscillation of said wobble plate about said third axis causing said slider member and said displacer piston to reciprocate in predetermined phased relationship with the reciprocation of said power piston, thereby to establish the proper sequence of relative motion between the two pistons to permit the engine to operate according to the Stirling cycle when a gas within the cylinder is heated.

2. The engine of claim 1 wherein said displacer piston rod passes through an axial bore in said power piston.

3. The engine in claim 2 wherein the end of said power piston facing said displacer piston has an axially projecting guide sleeve which is aligned with said axial bore and which telescopically receives and guides said displacer piston rod.

4. The engine of claim 1 wherein said power piston rod is bifurcated to permit said displacer piston rod to pass through said power piston and to connect to said slider member without interference between the two piston rods.

5. The engine of claim 1 wherein said connecting means between said slider member and said wobble plate comprises a ball-like cam member mounted on said wobble plate and adapted to ride within a slot-like formation in said slider member, said cam member being so positioned on said wobble plate relative to the point of connection between said power piston rod and said gimbal means as to cause said displacer piston to lead said power piston by the desired predetermined phase angle.

6. The engine of claim 1 wherein said displacer piston is fabricated in two axially aligned segments which are separated by a temperature insulating spacer.

7. The engine of claim 1 wherein the relative diameters of said displacer piston and the bore of the cylinder are selected to provide an annular gap therebetween to permit passage of gas past said displacer piston, said displacer piston being maintained centered within the cylinder bore by a multilobed bearing spacer on said displacer piston which maintains said annular gap except where said lobes contact the inner walls of the cylinder.

8. The engine of claim 1 wherein torque and other reaction forces from the drive mechanism are substantially absorbed by the mounting between said gimbal means and said supporting frame to minimize side loading forces between the power piston and the cylinder walls.

* * * * *